US012054933B2

(12) United States Patent
Heo

(10) Patent No.: US 12,054,933 B2
(45) Date of Patent: Aug. 6, 2024

(54) LEAKAGE PREVENTION DRAINAGE TRAP WITH JOINT REINFORCING MEMBER, AND INSTALLATION METHOD THEREOF

(71) Applicant: Young Ho Heo, Gimhae-si (KR)

(72) Inventor: Young Ho Heo, Gimhae-si (KR)

( * ) Notice: Subject to any disclaimer, the term of this patent is extended or adjusted under 35 U.S.C. 154(b) by 410 days.

(21) Appl. No.: 17/422,437

(22) PCT Filed: Jun. 18, 2019

(86) PCT No.: PCT/KR2019/007310

§ 371 (c)(1),
(2) Date: Jul. 12, 2021

(87) PCT Pub. No.: WO2020/149467

PCT Pub. Date: Jul. 23, 2020

(65) Prior Publication Data

US 2022/0090369 A1 Mar. 24, 2022

(30) Foreign Application Priority Data

Jan. 14, 2019 (KR) ..... 10-2019-0004594

(51) Int. Cl.
*E03F 5/04* (2006.01)

(52) U.S. Cl.
CPC ..... *E03F 5/0409* (2013.01)

(58) Field of Classification Search
CPC ..... E03F 5/0409; B01D 24/02
See application file for complete search history.

(56) References Cited

U.S. PATENT DOCUMENTS

| | | | |
|---|---|---|---|
| 5,216,767 | A | 6/1993 | Elmore |
| 2016/0281346 | A1 | 9/2016 | Clear et al. |
| 2018/0030713 | A1 | 2/2018 | Howson |

FOREIGN PATENT DOCUMENTS

| | | | |
|---|---|---|---|
| CN | 206299026 | U | 7/2017 |
| CN | 206545251 | U | 10/2017 |
| GB | 1153611 | A | 5/1969 |
| JP | H06-108644 | A | 4/1994 |
| JP | H09-125481 | A | 5/1997 |
| JP | 3038868 | U | 6/1997 |
| JP | 2005-226443 | A | 8/2005 |
| JP | 2012-202048 | A | 10/2012 |
| JP | 2015-110883 | A | 6/2015 |

(Continued)

OTHER PUBLICATIONS

English translation of International Search Report issued in application No. PCT/KR2019/007310 on Oct. 11, 2019.

*Primary Examiner* — Waqaas Ali
(74) *Attorney, Agent, or Firm* — Knobbe Martens Olson & Bear LLP

(57) ABSTRACT

The present disclosure relates to, in a drainage trap including a drainage pipe inserted into a drainage hole and an inlet portion formed at a top of the drainage pipe with a plurality of holes formed therein for performing a filtering function during drainage, a leakage prevention drainage trap with a joint reinforcing member and an installation method thereof. The joint reinforcing member 120 formed of a resin mesh or a metal mesh is coupled to an edge 113 of the drainage trap to be positioned between an upper portion of a mortar layer and tiles and is installed in a joint cement between the drainage trap and the tiles to firmly reinforce the joint cement.

2 Claims, 2 Drawing Sheets

(56) References Cited

FOREIGN PATENT DOCUMENTS

| | | | | |
|---|---|---|---|---|
| KR | 20-0378187 | | | 3/2005 |
| KR | 10-2005-0092624 | | | 9/2005 |
| KR | 10-0714443 | | | 5/2007 |
| KR | 10-2008-0017069 | A | | 2/2008 |
| KR | 10-2012-0134743 | | | 12/2012 |
| KR | 10-1290816 | B1 | | 7/2013 |
| KR | 10-2014-0067209 | | | 6/2014 |
| KR | 20140067209 | A | * | 6/2014 |
| KR | 10-2018-0134707 | | | 12/2018 |

* cited by examiner

LEAKAGE PREVENTION DRAINAGE TRAP WITH JOINT REINFORCING MEMBER, AND INSTALLATION METHOD THEREOF

TECHNICAL FIELD

The present disclosure relates to a leakage prevention drainage trap with a joint reinforcing member and an installation method thereof.

More specifically, the drainage trap comprises a drainage pipe inserted into a drainage hole, and an inlet portion formed at a top of the drainage pipe with a plurality of holes formed therein for performing a filtering function during drainage.

The present disclosure relates to a leakage prevention drainage trap with a mesh-shaped joint reinforcing member formed therein, wherein a groove 114 is formed along an edge of a drainage trap 110, a joint reinforcing member 120 is formed of a resin-made or metal-made mesh having a hole at a central portion and placed between a mortar layer 150 and floor tiles 160, and an edge of the hole at the central portion of the mesh is bent downward and inserted into the groove 114 of the edge of the drainage trap 110, and wherein in the groove 114 of the drainage trap 110 inserted with the edge of the central portion of the mesh, and between a drainage trap edge 113 and the tiles 160, a joint cement is filled and firmly placed by using the mesh as an aggregate.

In addition, the present disclosure relates to an installation method of a leakage prevention drainage trap with a mesh-shaped joint reinforcing member formed therein, comprising: inserting a drainage trap 110 into a drainage pipe 200 and forming a mortar layer 150 on a concrete layer 210 to reach a top of the drainage trap; placing a joint reinforcing member 120, which is formed of a resin-made or metal-made mesh having a hole at a central portion, on the mortar layer 150 by inserting an edge of the central portion of the mesh into a groove 114 formed at an edge of the drainage trap; installing tiles 160 on the joint reinforcing member 120 and the mortar layer 150; and filling a joint cement in the groove 114 of the drainage trap 110, in a gap between the drainage trap 110 and the tiles 160, and in a gap between the tiles.

BACKGROUND

A joint between a drainage trap installed in a drainage hole and tiles formed on a floor is filled with joint cement. However, the joint becomes cracked or damaged by becoming wet and dry, and water seeps into a lower mortar layer (a sand/cement layer through which water easily passes) by seeping through a gap. This has been a main cause of water leakage to a lower layer.

In order to solve the above-described problem of damage to the cement in the vicinity of the drainage trap, which has been the main cause of floor water leakage, a mesh-shaped joint reinforcing member is coupled to an edge of the drainage trap and positioned between the adjacent tiles and the mortar layer, and the joint cement is installed on the joint reinforcing member. Accordingly, the joint reinforcing member and the joint cement are combined and solidified to form a strong joint such that damage to the joint cement is prevented and the mesh is formed to serve as a primary waterproofing membrane.

In general, concrete is installed by inserting reinforcing bars into cement rather than using cement alone, which makes it possible to achieve remarkably strong reinforced concrete strength. Similarly, in the present disclosure, the joint reinforcing member is connected to the edge of the drainage trap and firmly positioned between the mortar layer and the tiles, and then joint cement is filled through a joint and is solidified, thereby forming remarkably strong joint cement.

As prior art for preventing water leakage in the vicinity of a drainage trap, a method of installing a drainage trap having a trench is disclosed in Korean Patent Application No. 10-2004-0017733. This method prevents water leakage by allowing water to be smoothly drained through a drainage hole.

In this regard, the present disclosure is to prevent damage of joint cement and leakage of water through a damaged gap by installing the joint cement with a joint reinforcing member inserted therein

SUMMARY

An object of the present disclosure provides a leakage prevention drainage trap with a joint reinforcing member at the edge and an installation method thereof, in which a mesh-shaped joint reinforcing member is connected to the edge of a drainage trap and installed between a mortar layer and tiles, and joint cement is filled to form firm bonding between the joint reinforcing member and the joint cement, thereby preventing damage such as cracking or the like to the installed joint cement, prolonging the lifespan thereof, and preventing water leakage due to damage to the joint cement near the drainage trap.

To achieve such an object, the present disclosure provides a leakage prevention drainage trap with a mesh-shaped joint reinforcing member formed therein, comprising: a drainage pipe inserted into a drainage hole; and an inlet portion formed at a top of the drainage pipe with a plurality of holes formed therein for performing a filtering function during drainage, wherein a groove 114 is formed along an edge of a drainage trap 110, a joint reinforcing member 120 is formed of a resin-made or metal-made mesh having a hole at a central portion and placed between a mortar layer 150 and floor tiles 160, and an edge of the hole at the central portion of the mesh is bent downward and inserted into the groove 114 of the edge of the drainage trap 110, and wherein in the groove 114 of the drainage trap 110 inserted with the edge of the central portion of the mesh, and between a drainage trap edge 113 and the tiles 160, a joint cement is filled and firmly placed by using the mesh as an aggregate.

In addition, the present disclosure provides an installation method of a leakage prevention drainage trap with a mesh-shaped joint reinforcing member formed therein, comprising: inserting a drainage trap 110 into a drainage pipe 200 and forming a mortar layer 150 on a concrete layer 210 to reach a top of the drainage trap; placing a joint reinforcing member 120, which is formed of a resin-made or metal-made mesh having a hole at a central portion, on the mortar layer 150 by inserting an edge of the central portion of the mesh into a groove 114 formed at an edge of the drainage trap; installing tiles 160 on the joint reinforcing member 120 and the mortar layer 150; and filling a joint cement in the groove 114 of the drainage trap 110, in a gap between the drainage trap 110 and the tiles 160, and in a gap between the tiles.

The joint reinforcing member of the present disclosure is a mesh type having a plurality of small pores and formed of a metal mesh such as a wire mesh or a resin mesh, and when the joint cement is filled thereon, the cement enters the small pores to form the joint cement firmly.

The joint reinforcing member of a predetermined size has the hole at the central portion, the central portion can be folded to couple with the edge of the drainage trap, and the joint reinforcing member may be formed into an appropriate shape depending on a coupling type.

The joint reinforcing member is placed on the mortar layer in a state in which the central portion thereof is coupled to the edge of the drainage trap, and the tiles are installed on the joint reinforcing member.

when the joint cement is filled and installed between the joint reinforcing member and the tiles near the drainage trap and in a gap between the tiles, the joint cement with firm strength is formed by the joint reinforcing member and the lifespan is remarkably prolonged, thereby preventing water leakage due to damage to the joint cement near the drainage trap.

In the present disclosure, the joint reinforcing member is coupled by inserting an L-shaped coupling portion formed along the edge of the central portion of the joint reinforcing member into a groove formed along the edge of the drainage trap, or coupled in various other forms, thereby forming a firm coupling.

The drainage pipe is installed at the position of the drainage hole, the drainage trap is inserted into the drainage pipe, and then the mortar layer formed by mixing sand and cement is formed on the concrete layer at a thickness up to the top end of the drainage trap.

The mortar layer is formed to create a gradient and formed slightly obliquely such that the height of the floor is low at the drainage trap portion and grows higher farther away from the drainage trap, whereby water can easily drain into the drainage trap.

Floor tiles are formed on the mortar layer, and the tiles adjacent to the drainage trap are installed to partially overlap with the joint reinforcing member, whereby the joint reinforcing member is firmly installed under the drainage trap and the tiles.

The joint reinforcing member is firmly coupled between the drainage trap and the tiles, and when the joint cement is filled in the joint near the drainage trap, the joint cement is solidified by forming a firm bond with the mesh of the joint reinforcing member, thereby significantly increasing the lifespan and the strength. Accordingly, water leakage due to damage to the joint adjacent to the drainage trap can be prevented.

In the conventional drainage trap, water seeps into the gap due to separation or damage of the joint between the drainage trap and the tiles, thereby causing water leakage. However, in the present disclosure, the mesh-shaped joint reinforcing member 120 is coupled to the edge of the drainage trap and formed between the mortar layer 150 and the tiles 160, and then the tiles are installed thereon and the joint cement is filled between the joint reinforcing member and the tiles, whereby the joint reinforcing member provides a remarkable reinforcement effect of making the joint firm and an effect of preventing a water leakage phenomenon, which occurs in the joint near the drainage trap, by preventing damage or separation of the joint around the drainage trap as the above role of the reinforcement.

DETAILED DESCRIPTION

Figure 1:
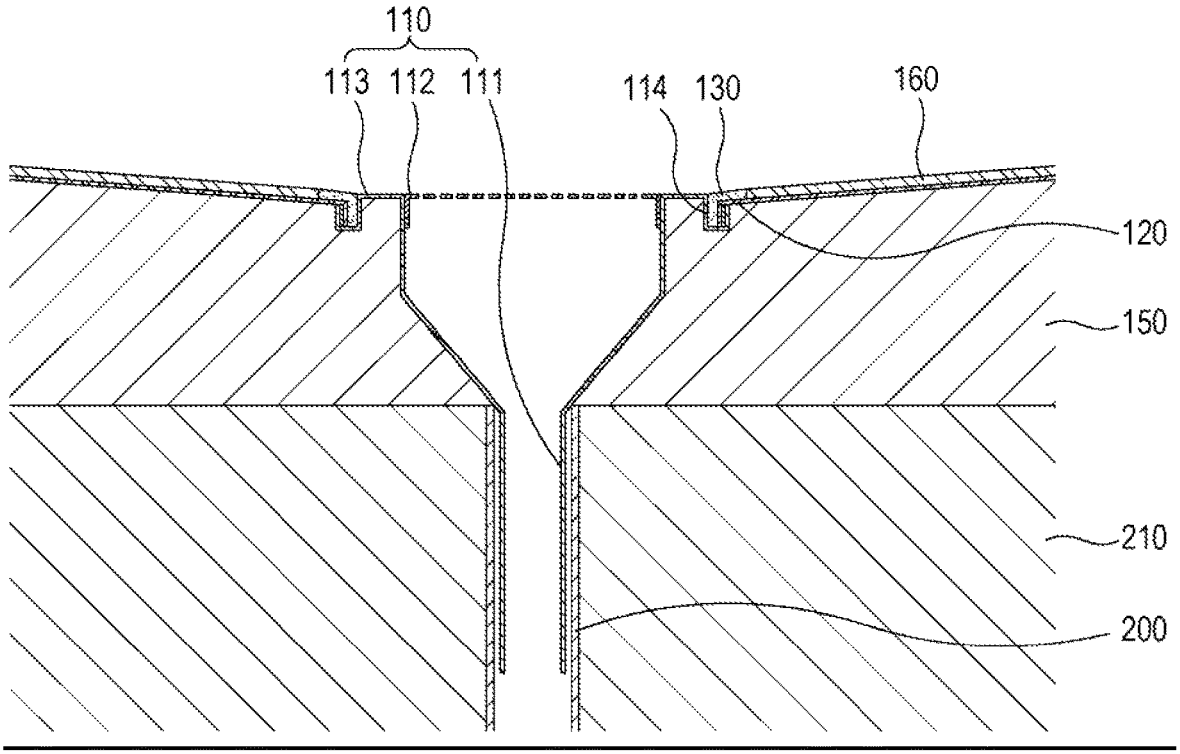
FIG. 1 is a cross-sectional view showing a drainage trap installed in one embodiment of the present disclosure.
Figure 2:
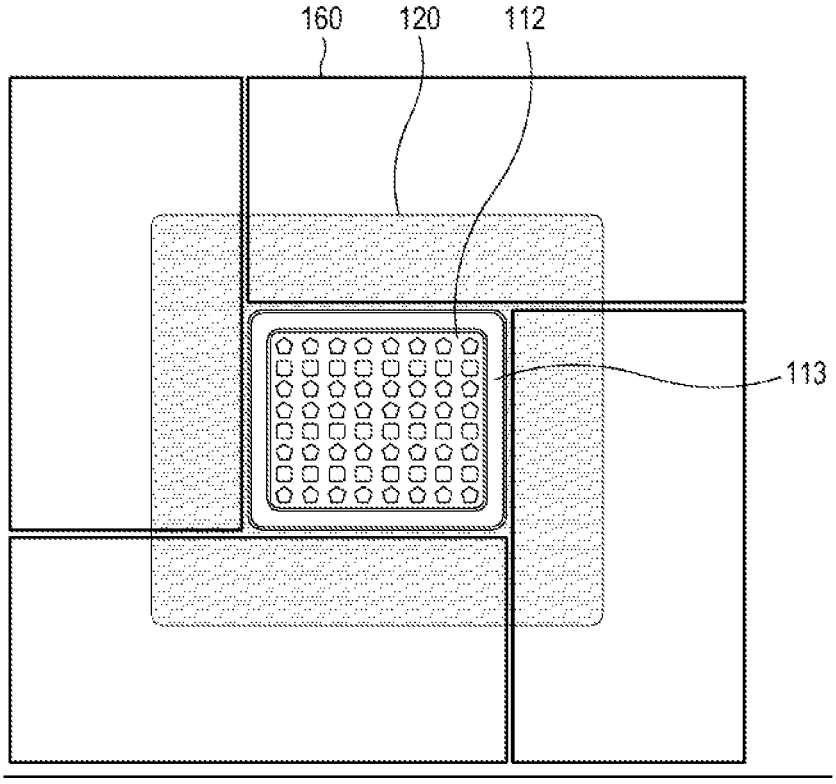
FIG. 2 shows a plan view of a configuration of the present disclosure.

FIG. 1 is an installation cross-sectional view of the present disclosure, and FIG. 2 shows a plan view of a configuration. The installation is performed through a step of forming the mortar layer 150 on the concrete layer 210, a step of inserting the drainage trap coupled with the joint reinforcing member into the drainage pipe 200, a step of installing tiles 160 on the joint reinforcing member 120 and the mortar layer 150, and a step of filling a joint cement in a gap between the drainage trap 110 and the tiles 160 and a gap between the tiles. As shown in FIG. 1, a groove 114 is formed on an edge 113 of the drainage trap 110, and the joint reinforcing member is hooked into the groove and coupled thereto.

As shown in FIGS. 1 and 2, the tiles 160 are installed on the joint reinforcing member 120 in such a manner that a portion of the joint reinforcing member 120 overlaps with the tiles 160.

The joint cement is installed by being filled in the joint 130 and is firmly formed by being solidified with the mesh-shaped joint reinforcing member inserted therein. Therefore, cracking or damage does not occur even after a long-term use, and as a result, there is a remarkable effect of preventing the occurrence of water leakage in the vicinity of the drainage trap 110.

The joint reinforcing member is formed of a mesh type such as a metal mesh, a resin mesh or the like, and the joint cement enters holes of the joint reinforcing member to form a solid bond with the mesh. With this structural reinforcement, the joint cement is stably maintained against cracking or separation caused by damage.

The configuration of the present disclosure is not limited to the above embodiment, and includes various embodiments that can be implemented within the general technical scope.

What is claimed is:

1. A leakage prevention drainage trap with a mesh-shaped joint reinforcing member formed therein, comprising:

a drainage pipe inserted into a drainage hole;

an inlet portion formed at a top of the drainage pipe with a plurality of holes formed therein for performing a filtering function during drainage; and a joint cement which fills the mesh-shaped joint reinforcing member, wherein a groove is formed along an edge of a drainage trap, the mesh-shaped joint reinforcing member is formed of a resin-made or metal-made mesh having a hole at a central portion and placed between a mortar layer and floor tiles, an edge of the central portion of the mesh is bent downward and inserted into the groove, and in the groove and in a gap between a drainage trap edge and the floor tiles, the joint cement is filled and placed by using the mesh as an aggregate.

2. An installation method of the leakage prevention drainage trap of claim 1 with the mesh-shaped joint reinforcing member formed therein, the installation method comprising:

inserting the drainage trap into the drainage pipe and forming the mortar layer on a concrete layer to reach a top portion of the drainage trap;

placing the mesh-shaped joint reinforcing member, which is formed of the resin-made or metal-made mesh having the hole at the central portion, on the mortar layer by inserting the edge of the central portion of the mesh into the groove formed at the edge of the drainage trap;

installing the floor tiles on the mesh-shaped joint reinforcing member and the mortar layer; and filling the gap between the drainage trap edge and the floor tiles, and a gap between the floor tiles, with the joint cement which fills the mesh-shaped joint reinforcing member.

* * * * *